United States Patent [19]

Shannon

[11] Patent Number: 4,863,403

[45] Date of Patent: Sep. 5, 1989

[54] ELECTRICAL POWER TAP

[75] Inventor: Suel G. Shannon, Harrisburg, Pa.

[73] Assignee: AMP Incorporated, Harrisburg, Pa.

[21] Appl. No.: 211,742

[22] Filed: Jun. 27, 1988

[51] Int. Cl.[4] ..... H01R 11/01

[52] U.S. Cl. ..... 439/783; 439/807

[58] Field of Search ..... 439/783, 790, 791, 803, 439/805, 807, 815

[56] References Cited

U.S. PATENT DOCUMENTS

| | | | |
|---|---|---|---|
| 1,801,277 | 4/1931 | Kelley | 439/783 |
| 3,305,253 | 2/1967 | Kopich | 287/58 |
| 4,027,939 | 6/1977 | White | 439/783 |
| 4,279,461 | 7/1981 | Bussen et al. | 439/783 |
| 4,415,222 | 11/1983 | Polidori | 439/807 |
| 4,600,264 | 7/1986 | Counsel | 439/807 |

*Primary Examiner*—P. Austin Bradley
*Attorney, Agent, or Firm*—Allan B. Osborne

[57] ABSTRACT

An electrical connector for use in electrically connecting a pair of cables. More particularly the connector includes a tapered, C-shaped member and a wedge member for being driven into the C-shaped member to secure the cables therein. According to one embodiment, bolts, cooperating with a flange crossing an end of the wedge member, are threadedly advanced into apertures on the C-shaped member to drive the wedge member. In a second embodiment, a bolt, mounted on the C-shaped member is threaded into a sleeve on the wedge member to pull it into the C-shaped member.

19 Claims, 4 Drawing Sheets

ELECTRICAL POWER TAP

BACKGROUND OF THE INVENTION

1. Field of the Invention

This invention relates to electrical connectors for tapping power cables to a continuous power cable and, more specifically, to such electrical connectors utilizing a wedge member driven into a C-shaped member to mechanically grip and electrically interconnect two cables.

2. Brief description of the Prior Art

Electrical connectors of the type having a tapered C-member with converging cable receiving channels and a complementary tapered wedge member to mechanically grip and electrically interconnect two electrical cables disposed in the channels are well known in the art. The cables are gripped and interconnected electrically by driving the wedge member into the C-member to drive the cables tightly against the wedge and C-member in the channels.

Four methods of driving the wedge member into the C-member are known. According to one such method, examples of which are set forth in Patents, 1,801,277 and 4,600,264, a bolt is threadedly attached to the C-member to drive the wedge. According to a second such method, an example of which is set forth in Patent 3,212,534, a tool having an explosively driven ram is used for driving the wedge into the C-member. According to a third method, examples of which are set forth in Patents 3,257,499 and 3,304,962, an explosive charge in the wedge member cooperates with a stationary member to drive the wedge member into the C-member. A fourth such method, which is disclosed in Ser. No. 944,473, filed Dec. 19, 1986 provides an explosive charge and sliding ram in a housing on the C-member to drive the wedge member into engagement with the electrical cables positioned in the converging channels of the C-member.

Cable connectors of the above described type have proven very satisfactory because, not only do they retain the interconnected cables in contact with each other but, in addition, the grinding action caused by the force of the wedge against the cables provides a cleaning of the cable surfaces and thereby minimizes the electrical resistance between cables when the cables are in contact with each other or between cable and C-member when connection between cables is through C-member, in which case the C-member is electrically conductive.

A problem encountered with the above noted prior art connectors has been that a relatively large amount of physical labor was required to make the connection, especially where the explosive operated connectors were involved. Even the above noted non-explosive types of connectors required, in the case of interconnected C-member and wedge, loosening of the wedge to allow entry of the cables into the channel. Where the wedge is separate from the C-member, there is the problem of location of the two connector members concurrently when required to form a connection.

It is therefore readily apparent that an electrical connector of the above described type is sought wherein the connector parts are readily at hand and wherein the connection can be made rapidly with minimum skill and no need for complex or specialized equipment.

SUMMARY OF THE INVENTION

In accordance with the present invention, there is provided an electrical connector of the above described type which minimizes the problems encountered in like prior art connectors and wherein the cables can be loaded into the connector rapidly and with minimum effort, wherein the connector components are constantly secured to each other and wherein specialized tooling is not required to form the connection.

Briefly, in accordance with a first embodiment of the present invention, there is provided a C-shaped member having a pair of internally threaded bosses or sleeves on opposite ends and sides thereof. The wedge includes a flange, optionally rotatably secured to the wider top end thereof and having essentially flared or ovoid shaped apertures at opposite ends of the flange for receiving threaded bolts therethrough, the bolts being threaded into the bosses. The ovoid or flared shape compensates for different sized cables to permit some side movement of the wedge relative to the C-member. Since the bosses are positioned one at the front and one at the rear of the C-member, the flange is positioned at an angle to the C-member such that the channels are exposed for reception of cables therein. When the cables are positioned in the channels, the bolt heads are rotated, causing the flange and the wedge secured thereto to move into the C-member and provide a crushing action between cable and connector members. It can be seen that the attributes sought as noted above are present, the only tool required being a wrench to rotate the bolt.

In accordance with a second embodiment of the present invention, there is again provided a C-shaped member having an outwardly extending flange at a rear portion thereof with an essentially flared or ovoid bolt receiving aperture in the flange. The ovoid or flared aperture has the same function as stated for the flared or ovoid member hereinabove. The wedge includes a sleeve and a nut receiving and retaining region within the sleeve. The bolt is always threaded to the nut to retain the connector members together, the wedge and C-member being sufficiently separated in the fully disconnected position to permit entry of cables into the channels of the C-members. To provide the connection the bolt is rotated in the nut, the bolt thereby travelling downwardly into the sleeve. The head of the bolt impinges against the flange on the wedge and pulls the wedge into the C-member to provide the crushing action between cable and connector. It can be seen that the only tool required is a wrench to rotate the bolt.

DESCRIPTION OF THE PREFERRED EMBODIMENTS

Figure 1:
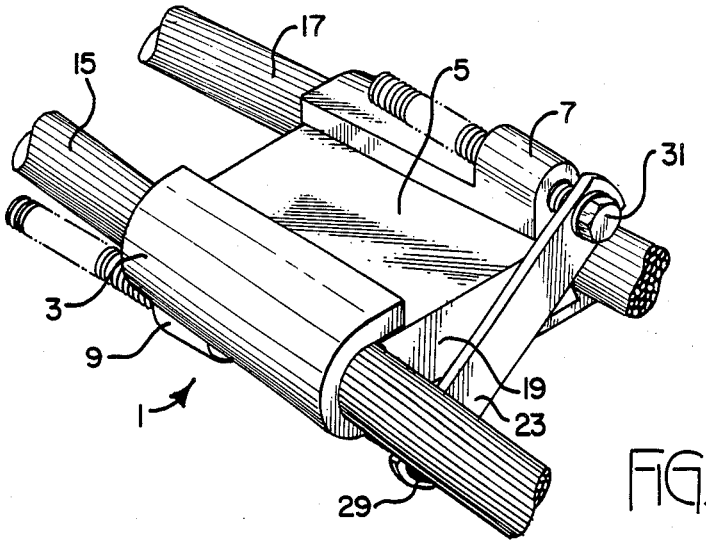
FIG. 1 is a perspective view of the connector in accordance with a first embodiment of the present invention in the through wire position.
Figure 2:
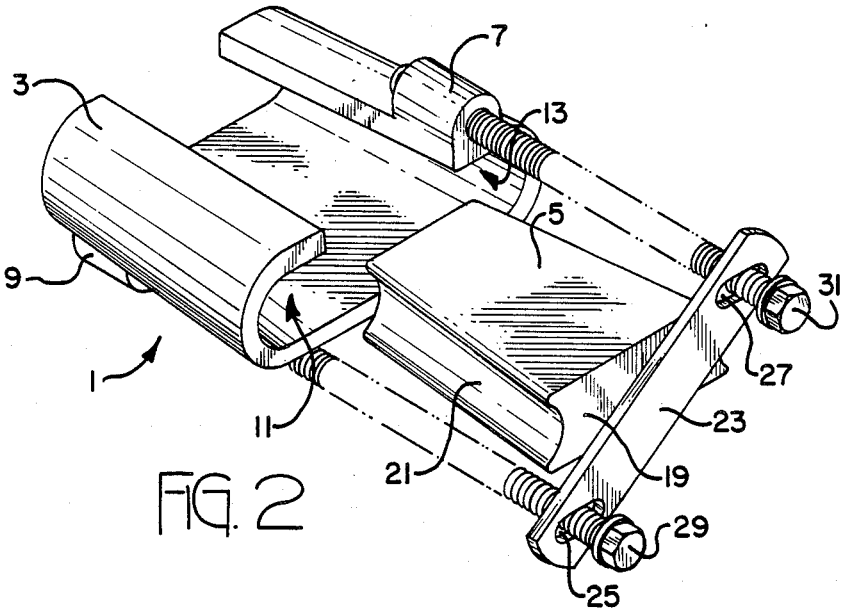
FIG. 2 is a view as in FIG. 1 but prior to insertion of cables and formation of a connection.
Figure 3:
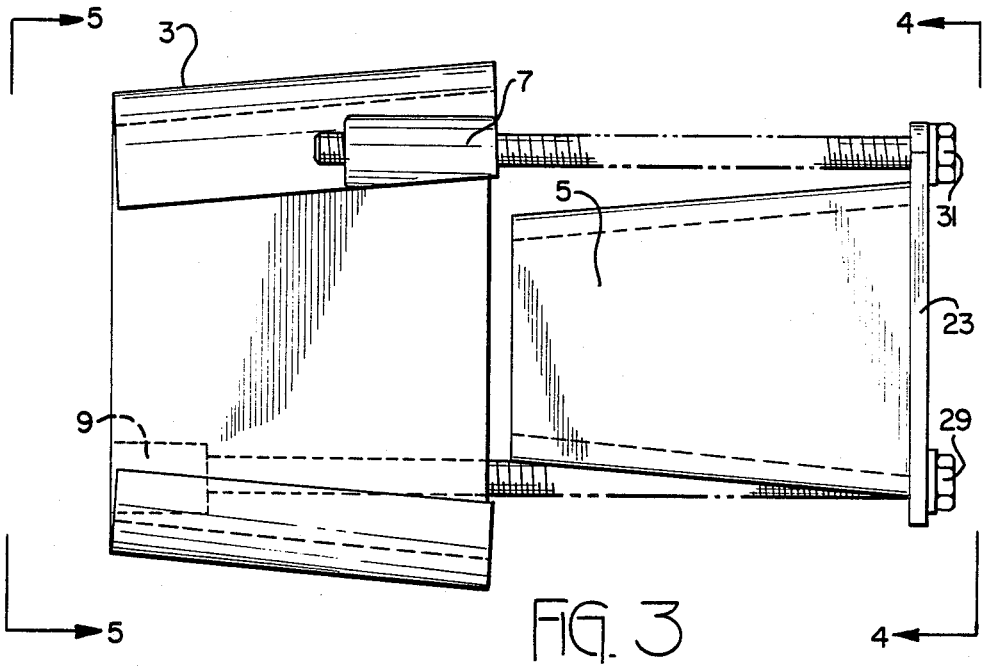
FIG. 3 is a side view of the connector of FIG. 2.
Figure 6:
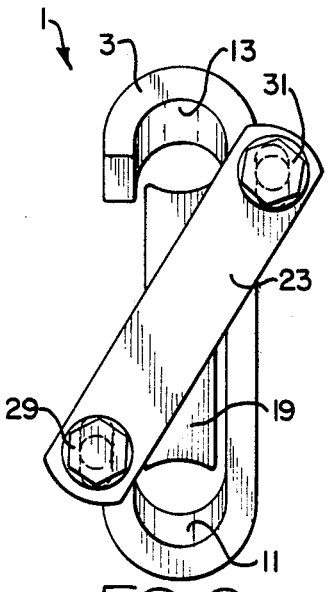
FIG. 6 is an alternate embodiment of the view in FIG. 4.
Figure 4:
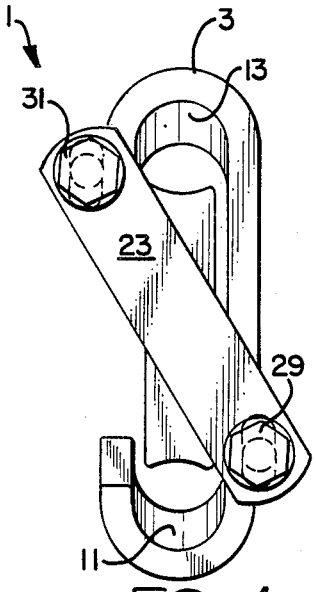
FIG. 4 is a view in the direction of the FIG. 4 arrow in FIG. 3.
Figure 5:
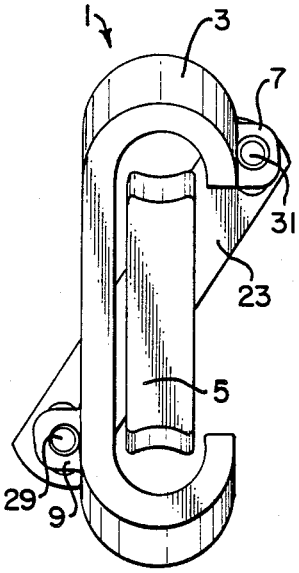
FIG. 5 is a view in the direction of the FIG. 5 arrow in FIG. 3.

Referring first to FIGS. 1 to 6, there is shown a connector 1 in accordance with a first embodiment of the present invention. The connector includes a C-member 3 and a wedge 5 as best shown in FIGS. 2 and 3. The C-member 3 includes an internally threaded boss 7 at the upper or wider end portion thereof and an internally threaded boss 9 at the lower or narrower end portion thereof on the side of the C-member opposite and remote from the boss 7. The C-member is formed either from electrically insulating or electrically conducting rigid material, depending upon its ultimate use as is well known in the art. The C-member 3 includes a pair of channels 11 and 13 on either side thereof formed by the curled portion of the "C", FIG. 1 showing cables 15 and 17 secured in these channels.

The wedge 5 is tapered and is narrower at its bottom portion than at its top portion 19. The wedge side walls 21 are preferably concave to accommodate cable therein. A flange 23 is preferably secured to the top portion 19 of the wedge 5 in a plane parallel to the wedge top, the flange having a pair of preferably flared or ovoid bolt receiving apertures 25 and 27. A pair of threaded bolts 29 and 31 extend through the apertures 25 and 27 and are threadedly engaged with the threads of the bosses 7 and 9. As can be seen, apertures 25, 27 are elongated to allow flange 23 to move from side to side of C-member 3 over a short distance to accommodate various cable sizes.

In operation, the connector 1 is initially as shown in FIGS. 2 and 3 with the bolts 29 and 31 engaged with the bosses 7 and 9 for only a short distance so that the wedge 5 is sufficiently spaced from the C-member 3 to permit placement of cables into the channels 11 and 13. Upon proper positioning of the cables 15 and 17 in the channels, the bolts 29 and 31 are threaded into the bosses 7 and 9, causing the wedge 5 to enter the C-member 3 and applying a force against the cables due to the taper to secure the cables in the connector. Preferably, bolts 29, 31 are threaded into bosses 7, 9 alternatively with each bolt 29, 31 being advanced over a short distance each time. If desired, the bolts can have two separate heads (not shown) whereby one of the heads breaks away when a predetermined torque has been applied. This ensures that the pressure on the cables from the wedge is at some predetermined amount.

Figure 7:
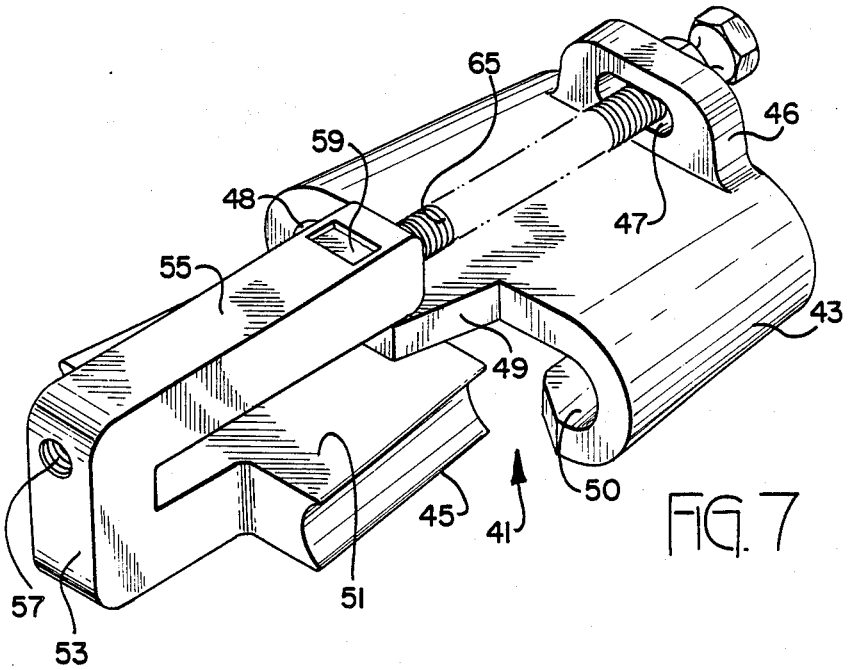
FIG. 7 is a perspective view of the connector in accordance with a second embodiment of the present invention prior to insertion of cables and formation of a connection.
Figure 8:
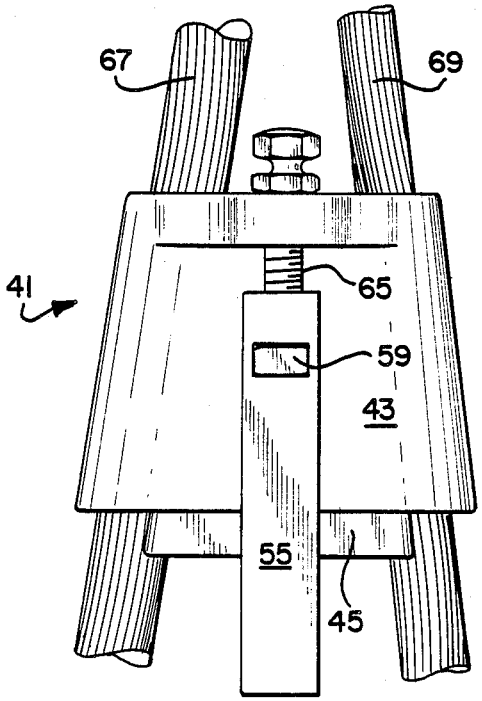
FIG. 8 is a side view of the connector of FIG. 7 after the connection is completed.

Referring now to FIGS. 7 to 9, 11 and 12, there is shown a connector 41 in accordance with a second embodiment of the present invention. The connector 41 includes a C-member 43 and a wedge member 45 as best shown in FIG. 7. The C-member 43 includes an outwardly extending flange 46 having a preferably flared or ovoid shaped bolt receiving aperture 47 at the narrow end thereof and an outwardly projecting flange portion 49 at the wide end thereof. The C-member also includes a pair of cable receiving channels 48 and 50 as shown in Figure 7.

Figure 9:
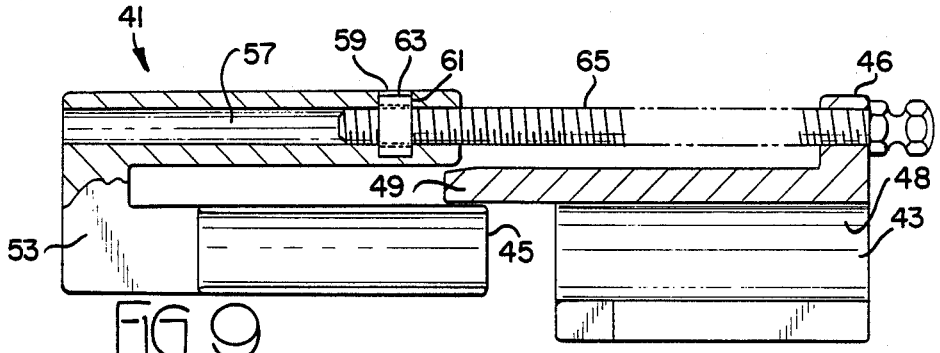
FIG. 9 is a cross section of the connector of FIG. 7.
Figure 10:
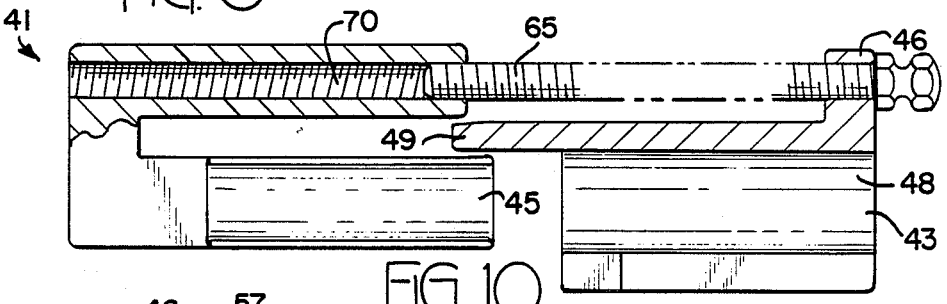
FIG. 10 is a cross section in accordance with a third embodiment of the connector of the present invention.
Figure 11:
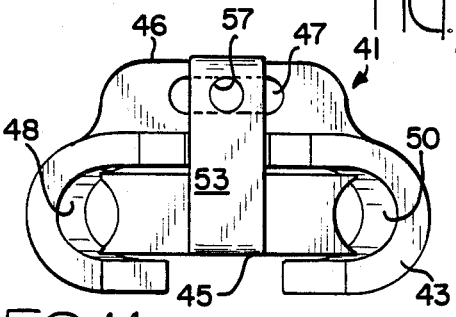
FIG. 11 is a bottom view of the connector of Figure 7.
Figure 12:
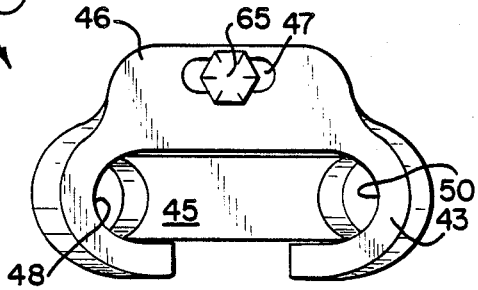
FIG. 12 is a top view of the connector of FIG. 7.

The wedge member 45 includes a wedge portion 51 which is coupled via a U-shaped section 53 to a sleeve member 55 having a passage 57 extending along the major axis thereof. The passage 57 can be threaded to receive the threads of a bolt or, as shown, there is provided a nut receiving aperture 59 in the side wall of the sleeve and a slot 61 (FIG. 9) for receiving and retaining a nut 63 in position thereat. A bolt 65 extends through the flared or ovoid aperture 47 and is threadedly engaged with the nut 63 as shown in FIG. 9. The flange portion 49 minimizes movement of the wedge relative to the C-member 43 due to its location in the U-shaped section 53.

In operation, the cables 67 and 69 are positioned in the channels 48 and 50 and the bolt 65 is then rotated and moves downwardly in the sleeve member 5 due to its threaded engagement with the nut 63. The C-member and wedge are forced together due to the force of the head of the bolt 65 on the flange 46 with the flange 49 moving into the groove created by the U-shaped section 53. When the wedge member 45 abuts the cables 67 and 69, the C-member will properly align itself with the cables due to the flared or ovoid aperture 47. The bolt 65 is continually turned until the force applied to the cables is adequate as determined in the manner optionally discussed in conjunction with the first embodiment or in other well known manner.

Referring now to Figrue 10, there is shown a third embodiment of the invention. This embodiment is identical to that of FIG. 7 to 9, 11 and 12 except that the nut 63 and nut receiving aperture 59 have been replaced by a threaded region 70 in the passage 57. This permits the threads on the bolt 65 to be in threaded engagement with the threads 67 for rotation therein to provide the movement to the flange portion 49 as described hereinabove with respect to the second embodiment of the invention.

Figure 13:
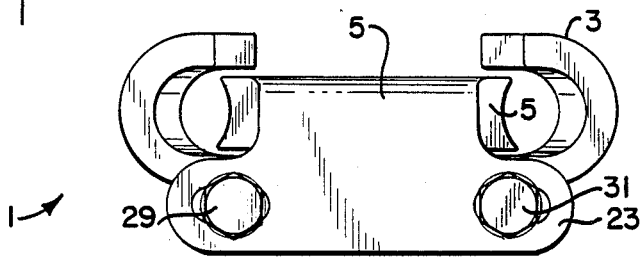
FIG. 13 is a top view of a fourth embodiment of the connector in accordance with the present invention.
Figure 14:
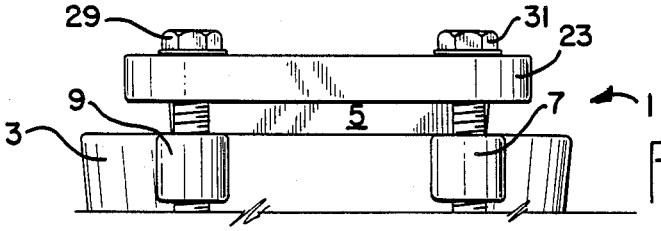
FIG. 14 is a side view of the top portion of the fourth embodiment of the connector in accordance with the present invention.

Referring now to FIGS. 13 and 14, there is shown a fourth embodiment in accordance with the present invention. This embodiment is the same as the embodiment of FIGS. 1 to 6 except that the threaded bosses 7 and 9 are both on the same side of the C-member 3.

It can be seen that there has been provided an electrical cable connector of the above described type which is easy to operate, does not require highly skilled personnel, can be made rapidly and does not require complex tooling.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. An electrical connector assembly for electrically coupling a pair of cables, comprising:

(a) a housing defining a pair of cable receiving channels;

(b) a tapered wedge member having a leading surface and a trailing surface and positionable within said housing to drive said cables against said housing; and (c) means for drawing the wedge member into said housing and into engagement with cables in said channels including a pair of threaded bosses on opposite surfaces of said housing, each boss being closely adjacent a different one of said channels, a flange having a pair of apertures and secured to the trailing surface of said wedge member and a pair of bolts, each of said bolts impinging against and extending through opposite end portions of said flange and threadedly engaged with one of said bosses.

2. An electrical connector as set forth in claim 1 wherein said apertures in said flange are ovoid and disposed on opposite ends of said flange.

3. An electrical connector as set forth in claim 2 wherein said apertures in said flange are parallel to the major axis of said housing.

4. An electrical connector as set forth in claim 1 wherein said flange is movable relative to said housing.

5. An electrical connector as set forth in claim 4 wherein said apertures in said flange are ones of flared and ovoid shape and disposed on opposite ends of said flange.

6. An electrical connector as set forth in claim 1 wherein said housing has tapered C-shaped cross-section, one of said bosses being disposed closely adjacent the wide end of said housing and the other of said bosses being disposed closely adjacent the narrow end of said housing.

7. An electrical connector as set forth in claim 6 wherein said flange is movable relative to said housing.

8. An electrical connector as set forth in claim 7 wherein said apertures in said flange are ones of flared and ovoid shape and disposed on opposite ends of said flange.

9. An electrical connector assembly for electrically coupling a pair of cables, comprising:

(a) a housing having a tapered C-shaped cross section defining a pair of cable receiving channels and further having a first flange extending outwardly from one surface adjacent a narrow end thereof and a downwardly extending second flange at a wide end thereof, said first flange having an aperture therethrough;

(b) a tapered wedge member positionable within said housing to drive said cables against said housing , said wedge member including a sleeve attached thereto by a U-shaped member with said sleeve having means therein for threadedly receiving a threaded member; and (c) a threaded member extending through said aperture to said first flange and threadedly received in said sleeve for drawing the wedge member into said housing and into engagement with cables in said channels with said second flange being disposed between said sleeve and said wedge member.

10. An electrical connector as set forth in claim 9 wherein said means in said sleeve for receiving a threaded member includes threads therein.

11. An electrical connector as set forth in claim 9 wherein said means in said sleeve for receiving a threaded member includes a nut receiving aperture in said sleeve and a nut positioned against rotation within said aperture.

12. An electrical connector assembly for electrically coupling a pair of cables, comprising:

(a) a housing defining a pair of cable receiving channels;

(b) a tapered wedge member having a leading surface and a trailing surface and positionable within said housing to drive said cables against said housing; and (c) means for drawing the wedge member into said housing and into engagement with cables in said channels including a pair of threaded bosses on opposite end portions on one of the surfaces of said housing, each boss being closely adjacent a different one of said channels, a flange having a pair of apertures and secured to the trailing surface of said wedge member and a pair of bolts, each of said bolts impinging against and extending through opposite end portions of said flange and threadedly engaged with one of said bosses.

13. An electrical connector as set forth in claim 12 wherein said apertures in said flange are ovoid and disposed on opposite ends of said flange.

14. An electrical connector as set forth in claim 13 wherein said apertures in said flange are parallel to the major axis of said housing.

15. An electrical connector as set forth in claim 12 wherein said flange is movable relative to said housing.

16. An electrical connector as set forth in claim 15 wherein said apertures in said flange are ones of flared and ovoid shape and disposed on opposite ends of said flange.

17. An electrical connector as set forth in claim 12 wherein said housing has tapered C-shaped cross section, one of said bosses being disposed closely adjacent the wide end of said housing and the other of said bosses being disposed closely adjacent the narrow end of said housing.

18. An electrical connector as set forth in claim 17 wherein said flange is movable relative to said housing.

19. An electrical connector as set forth in claim 18 wherein said apertures in said flange are ones of flared and ovoid shape and disposed on opposite ends of said flange.

* * * * *

UNITED STATES PATENT OFFICE

CERTIFICATE OF CORRECTION

Patent No. 4,863,403 Dated September 5, 1989

Inventor(s) Suel G. Shannon

It is certified that error appears in the above-identified patent and that said Letters Patent is hereby corrected as shown below:

Column 5, line 54, claim 9, "to" should be "in".

Signed and Sealed this

Seventeenth Day of July, 1990

*Attest:*

HARRY F. MANBECK, JR.

*Attesting Officer*

*Commissioner of Patents and Trademarks*